United States Patent [19]

Rekow

[11] 4,253,578

[45] Mar. 3, 1981

[54] MERCHANDISE DISPLAY RACK

[76] Inventor: John A. Rekow, 6130 SW. Taylors Ferry Rd., Portland, Oreg. 97219

[21] Appl. No.: 30,155

[22] Filed: Apr. 16, 1979

[51] Int. Cl.[3] ..... A47F 5/10

[52] U.S. Cl. ..... 211/208; 211/204

[58] Field of Search ..... 211/207, 208, 189, 193, 211/182, 204, 190; 248/163

[56] References Cited

U.S. PATENT DOCUMENTS

| | | | |
|---|---|---|---|
| 96,107 | 10/1869 | Hatfield | 211/208 |
| 963,030 | 7/1910 | Balch | 211/189 X |
| 4,146,141 | 3/1979 | Winter et al. | 211/208 |

FOREIGN PATENT DOCUMENTS

| | | | |
|---|---|---|---|
| 795638 | 10/1968 | Canada | 211/208 |
| 2296389 | 7/1976 | France | 211/193 |

*Primary Examiner*—James T. McCall
*Assistant Examiner*—Robert W. Gibson, Jr.
*Attorney, Agent, or Firm*—James D. Givnan, Jr.

[57] ABSTRACT

A rack is disclosed having outwardly extending support members arranged in the general configuration of a triangle with the support members receiving arms on which merchandise may be suspended. The obtuse relationship of the support members permits virtually the entire length of the support member to be utilized for merchandise display without interference with merchandise carried by an adjacent support member. The support members may be contiguous, non-contiguous, of like height, or of dissimilar heights above a floor. Arms are adjustably affixable to the support members and may be inclined to better display the merchandise suspended therefrom.

4 Claims, 9 Drawing Figures

MERCHANDISE DISPLAY RACK

BACKGROUND OF THE INVENTION

The present invention concerns display racks of the type used in retail establishments.

It has been determined that merchandise sales are directly related to the degree of merchandise exposure, and accordingly it is highly advantageous to display merchandise to the broadest possible extent. As display space is limited, it is in the merchandiser's best interests to best utilize the floor area available for display. Existing display racks do not utilize floor square footage area to the maximum. For example, round display racks which have a circular bar on which clothes hangers are supported, incur a lost central area while conventional racks with radiating arms incur a lost central area where said arms interconnect with a central upright support. Another drawback to existing racks, particularly round racks, is that the prospective purchaser is denied a frontal view of the clothing, and requires the buyer to handle each article inspected.

SUMMARY OF THE PRESENT INVENTION

The present invention is embodied within a rack having merchandise supporting members orientated to one another in a novel relationship.

The present display rack includes outwardly extending support members, disposed a distance above floor level, to display articles with a minimum of lost or wasted space. The support members carrying said arms may be briefly described as being in vertical planes which planes contain the sides of a triangle. The support members have an extended or major segment on which arms may be mounted. Further, rack base components may be telescopic for adjusting support member height above a floor.

Important objects of the present rack include the provision of a merchandise display rack effectively utilizing the floor area of a store by displaying a large number of articles to the customer's view; the provision of a display rack having support members arranged in what may be termed an extended triangle to avoid a lost center area the latter typical with conventional racks; the provision of a rack wherein the support members are positionable within vertical planes defining a triangle; the provision of a durable rack utilizing low cost tubular construction adapted to receive arms from which the merchandise is suspended; the provision of a rack with arms adjustably mounted thereon.

DETAILED DESCRIPTION OF THE PREFERRED EMBODIMENTS

Figure 1:
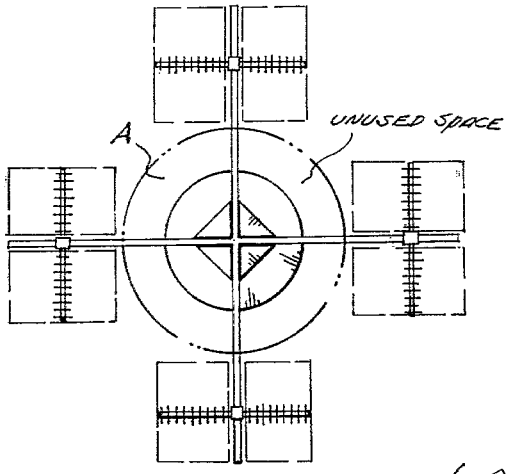
FIG. 1 (PRIOR ART)
FIGS. 1 and 2 are schematic plan views of conventional display racks having unutilized central areas.
Figure 2:
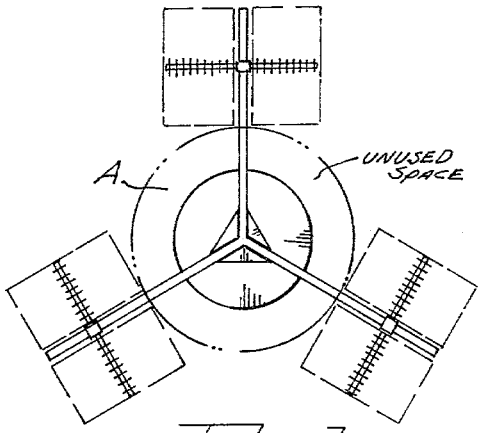
FIG. 2 (PRIOR ART)

With continuing attention to the drawings, FIGS. 1 and 2 show existing display racks in plan view both of which have sizable central areas A which are, in effect, lost space in that merchandise cannot be displayed there by reason of interference with other merchandise supported on remaining rack supports. Even if so displayed, such merchandise would be largely inaccessible. Such results from the horizontal rack supports radiating from a common center. For example, the display of large clothing articles such as shirts, trousers, dresses, coats may only be done at the arm extremities thus precluding or severely limiting rack utilization with consequent waste of floor space. As earlier noted, floor space is critical in most retail establishments, such lost floor space is highly undesirable from a merchandising standpoint.

Figure 3:
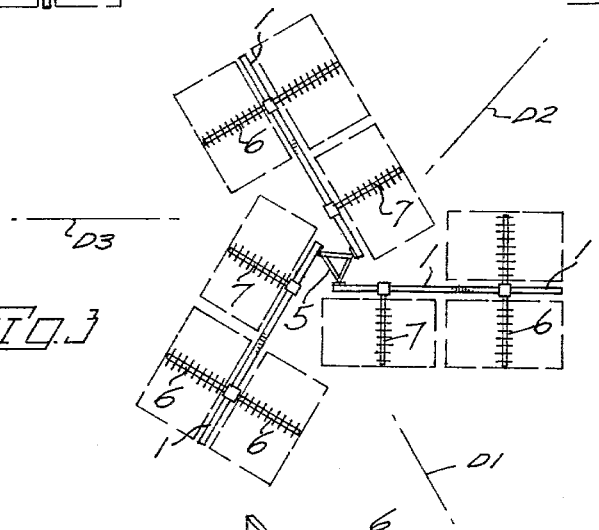
FIG. 3 is a plan view of the present display rack also shown in schematic form.

With attention now to FIG. 3 wherein the present display rack is shown in plan view, the same includes support members 1 arranged generally in a triangular manner in that rack segments (or their projected axes, or a combination of same) each intersect a remaining support member to describe a triangle side with each side common to or within a vertical plane defining the side of a triangle. Accordingly, the support members do not radiate from a common center of the display rack but rather are offset from same to best utilize virtually the full length of a support member or at least a major segment of same for merchandise display with little or no interference with other support members. Inner minor and outer major segments of each support member are defined by the intersection of a remaining support member axis and the vertical plane containing said each support member.

A rack base, indicated generally at 2, includes feet 3 with an upright support structure at 4. For ease of manufacturing, the base may be of tubular construction wherein feet 3 are formed integral with the upright support standards 4 of the support structure. The rack base includes brackets at 5 which interconnect standards 4. Desirably the standards include telescopic components at 4A which include push button type locks registrable with standard openings 4B to permit standard length and hence support member 1 height to be varied within a vertical plane containing a triangle side. Of course, the supports 4 may otherwise be of fixed uniform or fixed different lengths.

Support members 1 are shown as being of square tubing but, of course, may be of other sectional shape.

Figure 7:
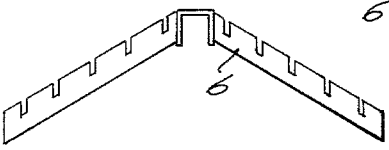
FIGS. 7 and 8 are side elevational views of support arms usable with the present rack.
Figure 8:
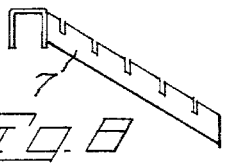
Figure 4:
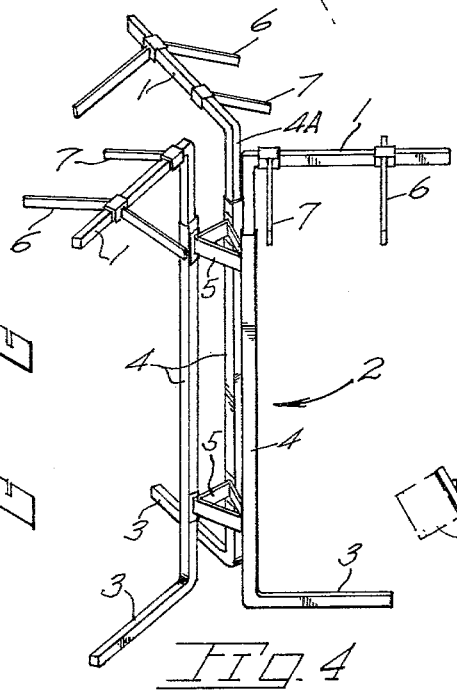
FIG. 4 is a perspective view of a rack embodying the present invention.
Figure 9:
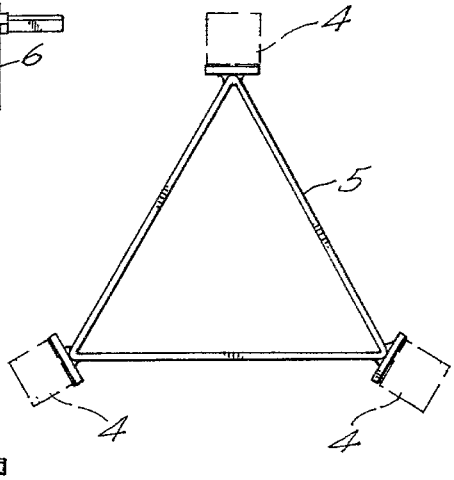
FIG. 9 is an enlarged plan view of a bracket of the present rack fitted with mounting plates at each of its corners.
Figure 5:
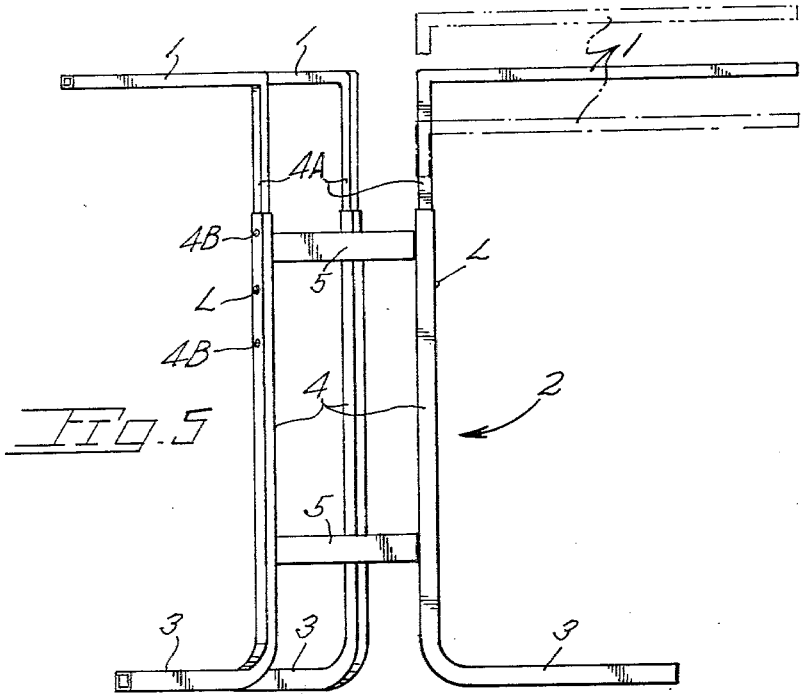
FIG. 5 is a front elevational view of FIG. 4.

Shown at FIGS. 7 and 8 are double and single arm members 6 and 7 engageable with the support members 1 of each rack. Each of said arm members engageable with its support member at a point therealong to best accommodate the specific merchandise to be displayed. Double arm member 6 has a pair of extensions each slotted (or apertured) to receive clothes hangers or the like. The double arm members are primarily for use adjacent a support member extremity while single arm member 7 is intended for placement on its support member adjacent the inner end of same, such as shown in FIG. 3. The support arms may take other configurations such as horizontal.

With reference again to FIG. 3, a shopper approaching via directions D-1, D-2 or D-3 will be presented with an unobstructed display of merchandise supported on three support arms (two double and one single) and will view a greater display of merchandise than a shopper similarly approaching either of the rack shown in FIGS. 1 and 2.

Figure 6:
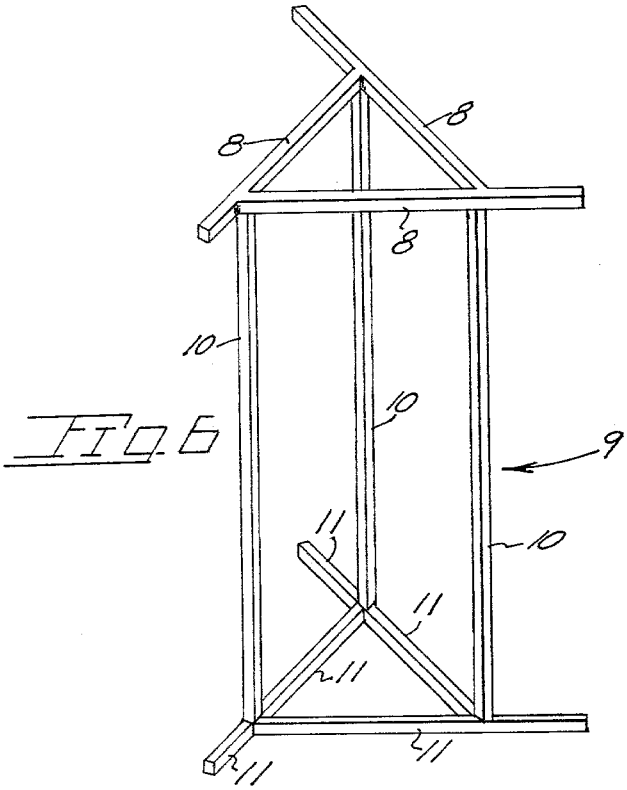
FIG. 6 is a perspective view of a modified rack embodying the present invention.

As shown in FIG. 6, the present display rack may be of a unitary nature wherein the support members 8 are contiguous. Indicated generally at 9 is a rack base with upright standards 10 terminating downwardly in feet 11. The arrangement of feet 11 may be shown, i.e., parallel to a support member 8 if so desired.

The support arms 7 shown in FIGS. 7 and 8 are normally applied to a display rack of FIG. 6 so as to locate a single arm 7 in place on a triangular side of the rack with an extended segment of the support member serving to receive a double support arm 6.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

1. A merchandise display rack comprising, a base, three support members supported by said base with the projected major axis of each support member offset from the rack center and intersecting a vertical plane containing a remaining support member, each support member having an inner minor segment and an outer major segment defined by the axis and plane intersection, the major segment of each support member disposed outwardly beyond the axis and plane intersection, and arm members in place on the major segments of said support members and extending substantially laterally therefrom to receive merchandise to be displayed.

2. The rack claimed in claim 1 wherein said support members are horizontally coplanar.

3. The rack claimed in claim 2 wherein said support members are non-contiguous.

4. The rack claimed in claim 1 wherein said base includes upright standards one each supporting at its upper end a support member, said upright standards having a telescopic component and being axially adjustable to vary the height of its associated support member.

* * * * *